US005495324A

United States Patent [19]

Kopp

[11] Patent Number: 5,495,324

[45] Date of Patent: Feb. 27, 1996

[54] THERMAL FIXING SYSTEM FOR RECORDING MEDIA OF A PRINTER OR COPIER DEVICE THAT ARE PRINTED ON ONE OR BOTH SIDES

[75] Inventor: Walter Kopp, Taufkirchen, Germany

[73] Assignee: Siemens Nixdorf Informationssysteme AG, Paderborn, Germany

[21] Appl. No.: 194,526

[22] Filed: Feb. 10, 1994

[30] Foreign Application Priority Data

Jul. 28, 1993 [EP] European Pat. Off. ..... 93112069

[51] Int. Cl.[6] ..... G03G 15/20

[52] U.S. Cl. ..... 355/290; 219/216; 355/285

[58] Field of Search ..... 355/282, 285, 355/289, 290, 308, 309, 312, 24, 319; 219/216, 388, 464

[56] References Cited

U.S. PATENT DOCUMENTS

| | | | |
|---|---|---|---|
| 3,517,164 | 6/1970 | Huggins et al. | 219/216 X |
| 3,752,612 | 8/1973 | Van Duuren | 425/66 |
| 3,861,863 | 1/1975 | Kudsi | 219/216 |
| 4,147,922 | 4/1979 | Naeser et al. | 219/216 |
| 4,217,093 | 8/1980 | Steinlehner et al. | 219/216 X |
| 4,513,898 | 4/1985 | Spitsbergen | 226/44 |
| 4,561,792 | 12/1985 | Behrens et al. | 400/618 |
| 5,151,743 | 9/1992 | Yaguchi | 219/216 X |
| 5,323,944 | 6/1994 | Faust | 226/15 |

FOREIGN PATENT DOCUMENTS

| | | |
|---|---|---|
| 2717260 | 4/1982 | Germany . |
| 0124774 | 8/1982 | Japan . |
| 0120284 | 7/1983 | Japan . |
| 0255372 | 11/1986 | Japan . |
| 0292177 | 11/1988 | Japan . |

OTHER PUBLICATIONS

2244 Research Disclosure, Dec. 1989, No. 308, "Guide for Infused Copy Transport", p. 977 (disclosed anonymously).

*Primary Examiner*—Robert Beatty
*Attorney, Agent, or Firm*—Hill, Steadman & Simpson

[57] ABSTRACT

In a thermal fixing system for fixing toner images on the front side of a recording medium in an electrographic printer or copier device, the back side of the recording medium already having a fixed toner image. The thermal fixing means contains a heat transfer fixing station that fixes the toner images on the recording medium, and contains a pre-heating saddle that precedes the heat transfer fixing station in a running direction of the recording medium. A sliding surface that accepts the recording medium over its back side is allocated to the pre-heating saddle. The sliding surface is constructed of a toner-repellant material at least in a contact region with the recording medium. A separating device can separate the recording medium from the saddle.

16 Claims, 5 Drawing Sheets

THERMAL FIXING SYSTEM FOR RECORDING MEDIA OF A PRINTER OR COPIER DEVICE THAT ARE PRINTED ON ONE OR BOTH SIDES

BACKGROUND OF THE INVENTION

The invention is directed to a thermal fixing system for fixing toner images on the front side of a web-shaped recording medium in an electrographic printer or copier device, whereby the back side of the recording medium can already have a fixed toner image.

Thermal fixing devices that comprise a pre-heating saddle with a following fixing zone composed of a heated fixing drum and a pressure roller are employed in printer or copier devices for heat transfer fixing of toner images on a recording medium that is usually composed of paper.

Such thermal fixing devices are disclosed, for example, by U.S. Pat. No. 4,147,922 or Japan Abstract Vol. 13, No. 120, 24 Mar. 1989 (Japan-A-63-292177).

It is beneficial in electrographic printer devices that work in the highest speed range with, for example, a printing speed of more than 0.5 m/s, and that employ a heat transfer fixing station for fixing, to heat the paper web or the paper sheet to temperatures of approximately 100° C. or more before the actual heat transfer fixing process in order to thus obtain a good joining of the toner image to the paper surface.

When a paper web or a single sheet of paper that is already printed and fixed on one side, for example on the back side, is to be printed and fixed on the other side, then the first side which is already fixed must be conducted over the hot surface of the pre-heating saddle for heating the paper for the second fixing process. The following problems thereby arise in this second fixing process:

a) Continuous printer operation:

The print image that is already fixed and that runs over the hot surface of the pre-heating saddle is heated to such an extent that it assumes a condition ranging from tacky through fluid, and is partly smeared on the saddle surface. The more toner is transferred from the toner image onto the saddle surface the more toner collects on the saddle surface, until a visible destruction of the toner image on the paper occurs.

b) Waiting or Standby Operation:

While the printer is in the waiting or standby mode, the paper web having the already fixed print image lies on the hot saddle. The print image is heated to such an extent in the region of the surface of the pre-heating saddle that it assumes a tacky through fluid condition and sticks to the hot surface of the pre-heating saddle. When the paper web is started, the toner image is then torn from the surface of the paper web and remains sticking on the hot surface of the saddle.

SUMMARY OF THE INVENTION

It is an object of the invention to provide a thermal fixing means having a pre-heating saddle for fixing toner images on the front side of a recording medium in an electrographic printer or copier device, whereby the back side of the recording medium can already have a fixed toner image.

According to the invention, a thermal fixing system is provided for fixing toner images on a front side of a recording medium in an electrographic printer or copier device wherein a back side of the recording medium already has a fixed toner image. A heat transfer fixing station is provided for fixing the toner images on the recording medium. A pre-heating saddle precedes the heat transfer fixing station and a running direction of the recording medium has a sliding surface allocated thereto for accepting the recording medium over its back side. The sliding surface comprises a toner-repellant material at least in a contact region of the recording medium.

The specification of front side and back side of a recording medium is a purely relative matter for describing the two sides of a recording medium.

When the recording medium, which can be composed of single sheets or of continuous form paper, is conducted over a pre-heating saddle having a sliding surface that exhibits a repellant property for the tacky through fluid toner and has high abrasion resistance with respect to the paper web sliding thereon, then the thermal fixing means can be employed in printer or copier devices that work both in a simplex as well as in a duplex mode.

Materials that are manufactured of fluorine compounds such as, for example, PTFE or, respectively, PFA compounds, have proven beneficial. The material can be vapor-deposited, sprayed, or glued on an appropriate acceptance surface of a pre-heating saddle. PTFE or, respectively, PFA compounds exhibit extremely good repellency with respect to the toner material and exhibit extremely good properties regarding abrasion, due to the paper web.

In order to enhance the abrasion resistance, wear-reducing constituents such as graphite or glass fibers can be mixed to the PTFE or PFA to a more or less pronounced degree.

Since such pre-heating saddles are usually utilized in electrographic printer devices of the higher performance category (between 2 and 10 million DIN A4 pages per month), non-wearing operation over years is impossible. For this reason, it is meaningful when the saddle surface can be unproblematically and simply renewed as needed, without the expensive base structure of the heating saddle with heating elements having to be renewed. For this purpose, a toner-repellant layer can be vapor-deposited, sprayed, or glued onto thin metal plates, whereby these coated, individual plates are then interchangeably secured on the base structure of the pre-heating saddle.

In an advantageous embodiment of the invention, the toner-repellant layer is executed as a film which has a thin, thermally conductive adhesive layer on one side. The adhesive layer is implemented such that the film can be easily pulled from the saddle in the hot condition of the saddle. A fast renewal of the saddle surface is thus rapidly possible, as needed on site by the customer.

The toner-repellant layer can also be implemented as a thin film that is taken from a supply reel, is guided over the surface of the pre-heating saddle and is then again wound up. The film is thus moved extremely slowly relative to the running direction of the paper.

In order to obtain a fold-free entry of the paper web into the fixing gap between fixing drum and pressure drum, it has already been proposed to design that end of the pre-heating saddle facing toward the fixing gap as a smoothing edge over which the recording medium is deflected to a great degree. However, extremely high wear of the toner coating on the recording medium occurs in the wrap region in the region of the smoothing edge. This wear can be prevented when rollers that may potentially be provided with a toner-repellant coating are provided in the wrap region.

When a relatively high proportion of graphite or glass fibers is added to the toner-repellant material in order to achieve high wear resistance of the surface, then the repellency of the surface relative to the toner image may potentially be reduced. In order to prevent a transfer of the toner image onto the saddle surface in such cases during a long waiting or standby mode of the printer devices, it is beneficial to lift the recording medium off from the saddle surface. This can occur wherein an air pillow is produced between the paper web and the saddle surface or sliding surface with the assistance of a blower means in the standby condition of the printer device. Another possibility for lift-off is comprised in providing a suitable lift-up element designed, for example, as a tension wire that engages under the recording medium over its entire width. The pre-heating saddle and lift-off element are thereby moved relative to one another such that, in a lift-off status, the recording medium is guided over the lift-off element at a distance from the pre-heating saddle.

As a rule, the paper web is automatically placed into the printer in electrographic continuous form printers of the new generation. Among other things, the paper web must thereby be guided over the pre-heating saddle. Coatings composed of fluorine compounds electrostatically charge at their surface when paper slides thereon. Due to the electrostatic forces, the paper web adheres so firmly to the pre-heating saddle that it may potentially no longer be capable of being transported. An advantageous admixture of electrostatically conductive substances such as graphite or the like can prevent the formation of electrostatic charges. It is beneficial, given glued layers of material, when the adhesive is likewise conductive in order to thus produce a conductive connection between toner-repellant material and grounded carrier.

Embodiments of the invention are shown in the drawings and shall be set forth in greater detail below by way of example.

DESCRIPTION OF THE PREFERRED EMBODIMENTS

Figure 1:
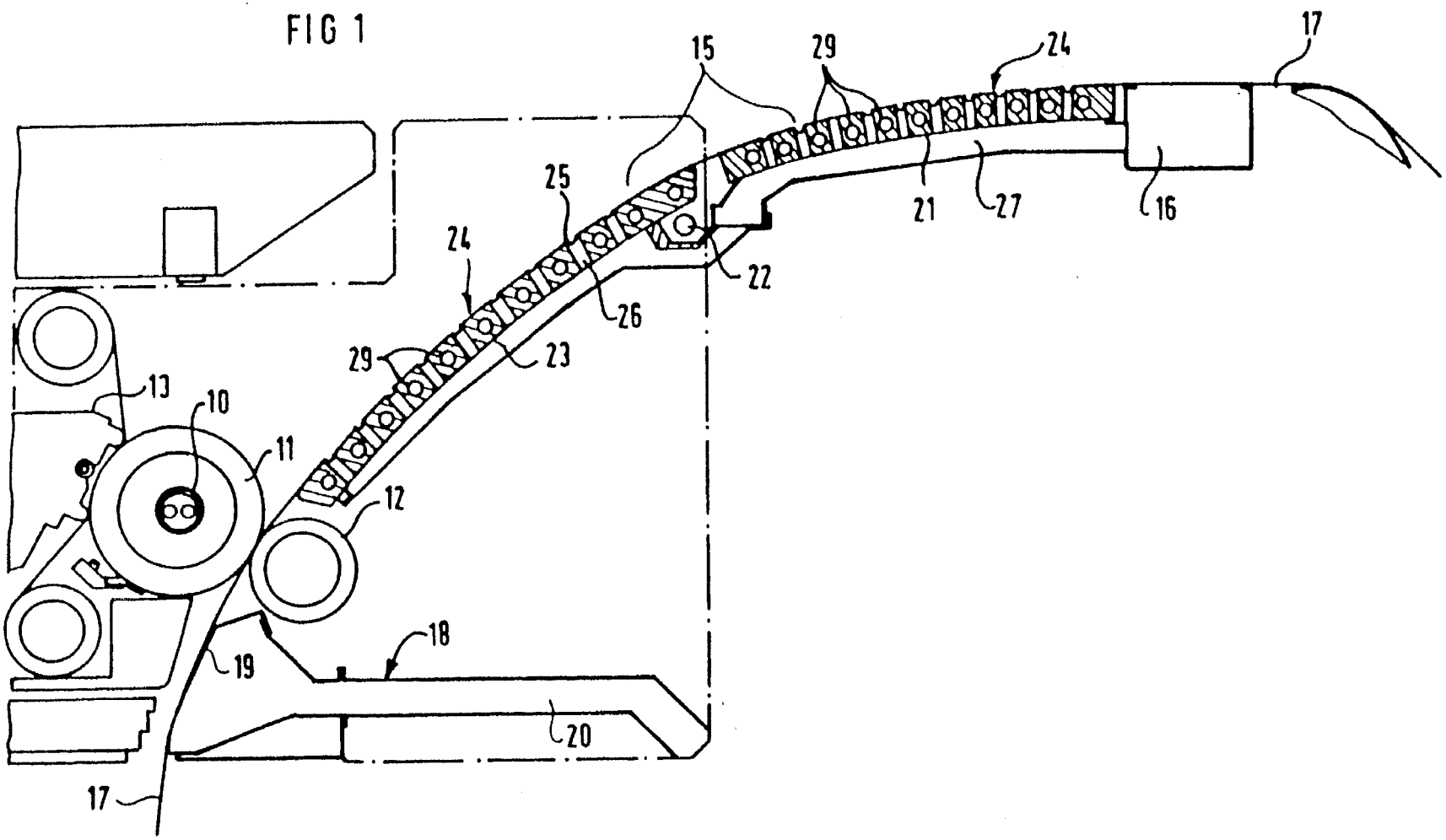
FIG. 1 is a schematic sectional view of a thermal fixing system for an electrographic printer device.

An electrographic printer device for printing continuous form papers contains a thermal fixing means schematically shown in FIG. 1 as disclosed in European Patent application, Serial No. 92118107.9, title "A Thermal Fixing Means for Printer or Copier Devices Having A Low-Temperature Pre-Heating Saddle" and in the corresponding subsequent PCT application having the same title. The cited application is a constituent part of the disclosure of the present patent application. The thermal fixing system is designed as a heat transfer fixing means. It contains a heating drum 11 heated via radiators 10 and contains a pressure roller 12 that can be electromotively pivoted against and away from the heating drum 11. The heating drum is composed of an aluminum cylinder having a heat-resistant coating arranged thereon. The pressure roller is likewise composed of an aluminum cylinder having a coating of silicone. The heating drum 11 is electromotively driven. The heating drum 11 has an oiling means 13 allocated to it for applying mold lubricant onto the heating drum. A heated pre-heating saddle 15 with negative pressure brake 16 associated therewith precedes the rollers as viewed in the conveying direction of the recording medium. This pre-heating saddle 15 serves the purpose of pre-heating a recording medium 17 designed as a continuous form paper and supplies it to the actual fixing gap between the rollers 11 and 12 in its pre-heated condition. The recording medium 17 is conducted over the pre-heating saddle 15 in taut fashion because it is decelerated by the negative pressure brake 16 and is driven via the rollers. A loose toner image on the recording medium is pre-heated on the pre-heating saddle 15 and is fixed between the rollers 11 and 12 by heat and pressure.

A cooling device 18 following the rollers 11 and 12 in the paper running direction provides for a cooling of the entire paper. For this purpose, the cooling device 18 contains a cooling surface 19 provided with apertures across which the recording medium 17 moves. Cold air supplied via an air delivery channel 20 flows from the apertures and produces a cooling air cushion under the recording medium 17. At the same time, air is blown onto the tonered side of the recording medium via a profile lying opposite thereto.

Given the described thermal fixing means, the pre-heating of the continuous form paper 17 occurs via a low-temperature pre-heating saddle 15 that is composed of two heated saddles connected following one another, namely of a stationary pre-heating saddle 21 and of a heating saddle 23 pivotable around a pivot point 22. Pre-heating saddle 21 providing a first heating zone of lower temperature and heating saddle 23 providing a second heating zone of higher temperature to thus form two separate heating zones as viewed in the paper running direction. The entire pre-heating path thereby has a length of approximately 500 through 700 mm. During the pre-heating, the paper 17 slides on sliding surfaces 24 of the pre-heating saddle 21 or heating saddle 23.

In order to produce a good contact between the saddles and the paper and to thus keep the temperature difference small, the sliding surface or the saddles are designed arcuately and with an arc radius that amounts to 700 mm in the illustrated example. Due to the arc of the sliding surfaces in combination with the traction by the rollers 11 and 12 and the deceleration by the negative pressure brake 16, a force component acts over the entire saddle length that presses the paper 17 against the sliding surfaces 24. Moreover, the stability of the paper running on the saddle is thereby enhanced. The saddles 21 and 23 comprise oblong depressions 25 transversely relative to the paper running direction which extend over the entire width of the saddles. They are connected to a channel 27 by lateral bores 26. The air channel proceeds under the saddles and is connected to a pneumatic means that produces an over-pressure and under-pressure, for example to a blower and to a pump. During the printing mode, the recording medium (paper) is suctioned against the sliding surfaces 24 of the saddles by under-pressure, and the water vapor being released due to the pre-heating is suctioned off. During standby mode, an air pillow is produced between the recording medium 17 and saddles or sliding surface 24 due to over-pressure.

The heating of the saddles 21 and 23 occurs with electrical resistance elements in the form of interchangeably arranged heating cartridges that are arranged in bores 29. The pre-heating saddle is designed as a low-temperature saddle whose heating capacity is controlled via a microprocessor-controlled regulator arrangement.

Figure 2:
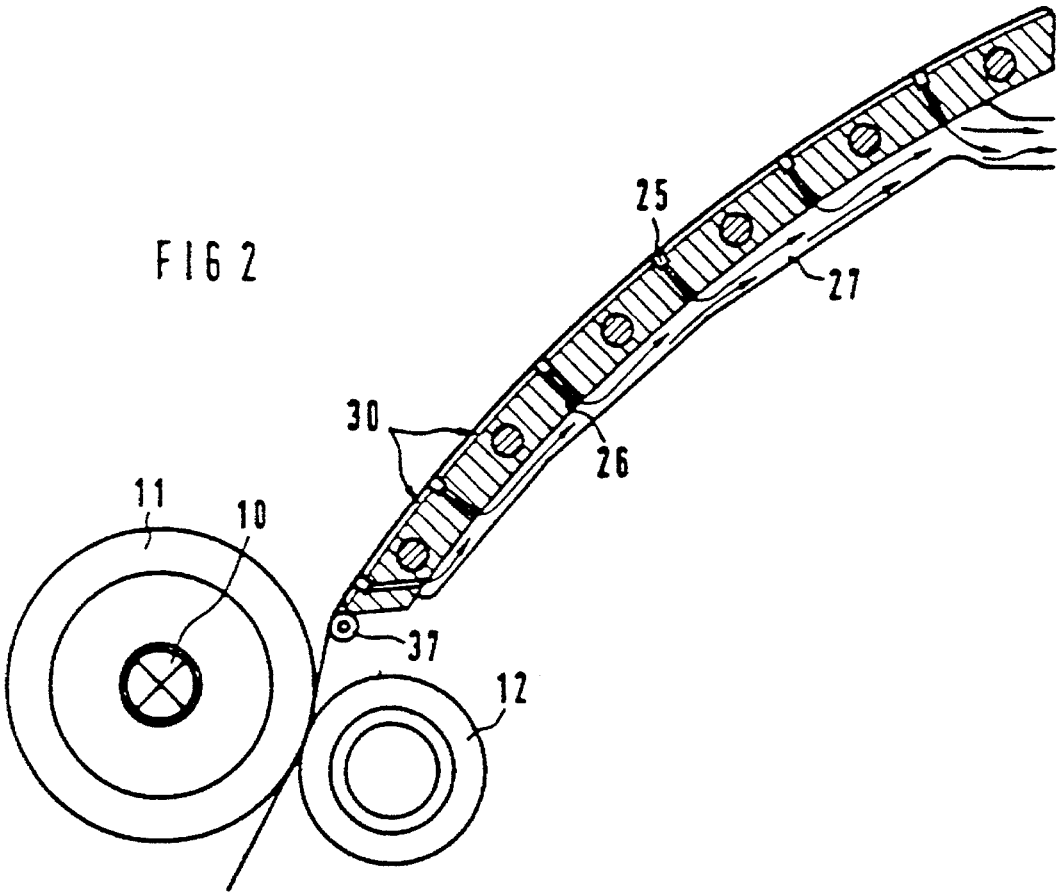
FIG. 2 is a schematic sectional view of a pre-heating saddle with a sliding surface composed of toner-repellant material.
Figure 3:
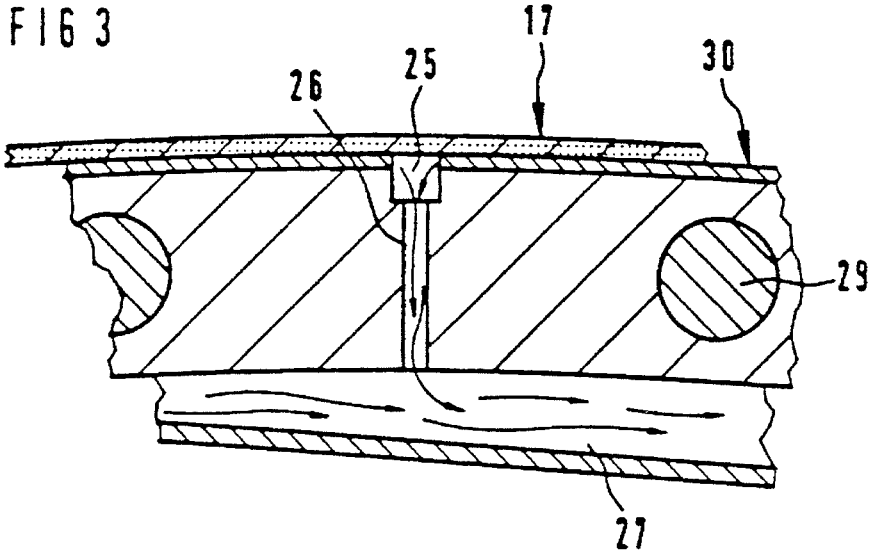
FIG. 3 is a schematic sectional view of a portion of FIG. 2.

The thermal fixing means is also suitable for fixing recording media that already have a fixed toner image on their back side. This toner image can be printed and fixed on the back side or on the front side of the recording medium in a first pass. After this, a further toner image is applied and fixed on the corresponding other side in a further pass. For this purpose, the sliding surface 24 according to the illustration of FIGS. 2 and 3 is composed of a toner-repellant plastic layer, of a fluorine compound, for example a PTFE or, respectively, a PFA compound, that is vapor-deposited, sprayed, or glued onto the worked surface of the pre-heating saddle 15. The compounds are described as follows:

Polytetrafluorethylene (PTFE) having the structural formula:

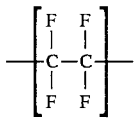

Perfluoroalkoxy polymers (PFA) having the structural formula:

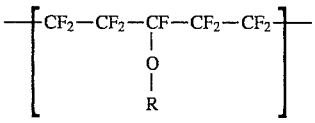

with $R=C_nF_{n+1}$ as a perfluoridated alkane side chain.

PTFE or PFA compounds exhibit extremely good repellency with respect to the toner material and extremely good properties with respect to abrasion due to the paper web. In order to enhance the abrasion resistance, constituents such as graphite or glass fibers can be added to a greater or lesser extent to the toner-repellant layer.

Since heating saddles are usually employed in electrographic printer devices of the upper performance category having a page capacity of 2 through 10 million DIN A4 pages per month, these heating saddles are subject to relatively high wear. For this reason, it is beneficial when the saddle surface can be unproblematically and simply renewed as needed without the expensive basic structure of the heating saddle with heating element having to be replaced as well.

Figure 4:
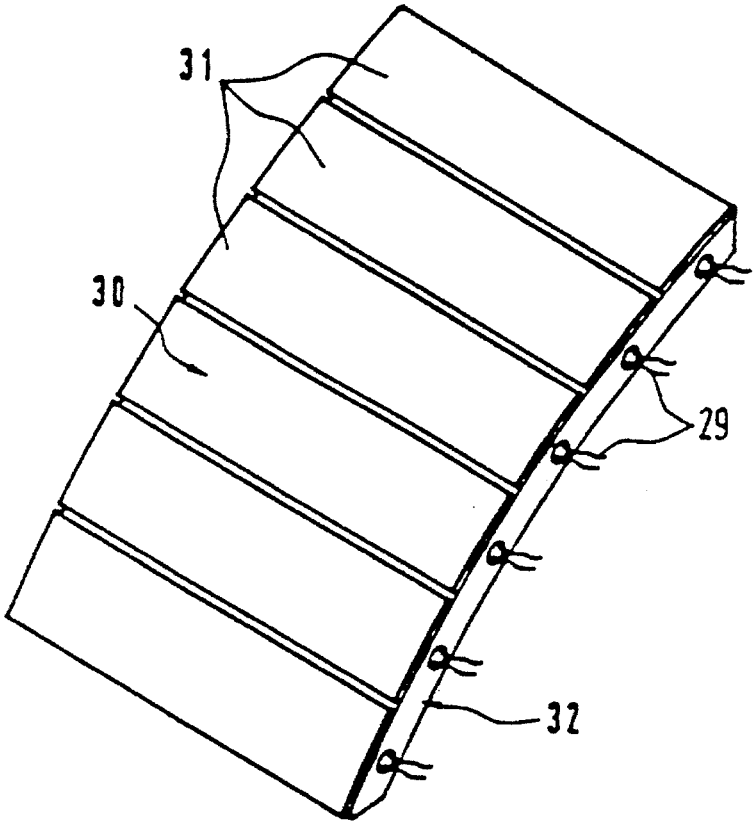
FIG. 4 is a schematic illustration of a pre-heating saddle having coated metal plates arranged thereon as a sliding surface.

In order to enable this replaceability, the toner-repellant layer 30 in an exemplary embodiment according to FIG. 4 is vapor-deposited, sprayed, or glued onto thin metal plates 31. The thin metal plates 31 can have a thickness of 1 through 5 mm and are interchangeably clamped or screwed on the basic structure 32 of the pre-heating saddle.

The toner-repellant layer 30 can also be executed as a thin film which has a thin, highly thermally conductive adhesive layer on one side. The adhesive layer is implemented such that the film can be easily pulled from the saddle in the hot condition of the saddle. A fast renewal of the saddle surface is thus very rapidly possible as needed on site at the customer.

Figure 5:
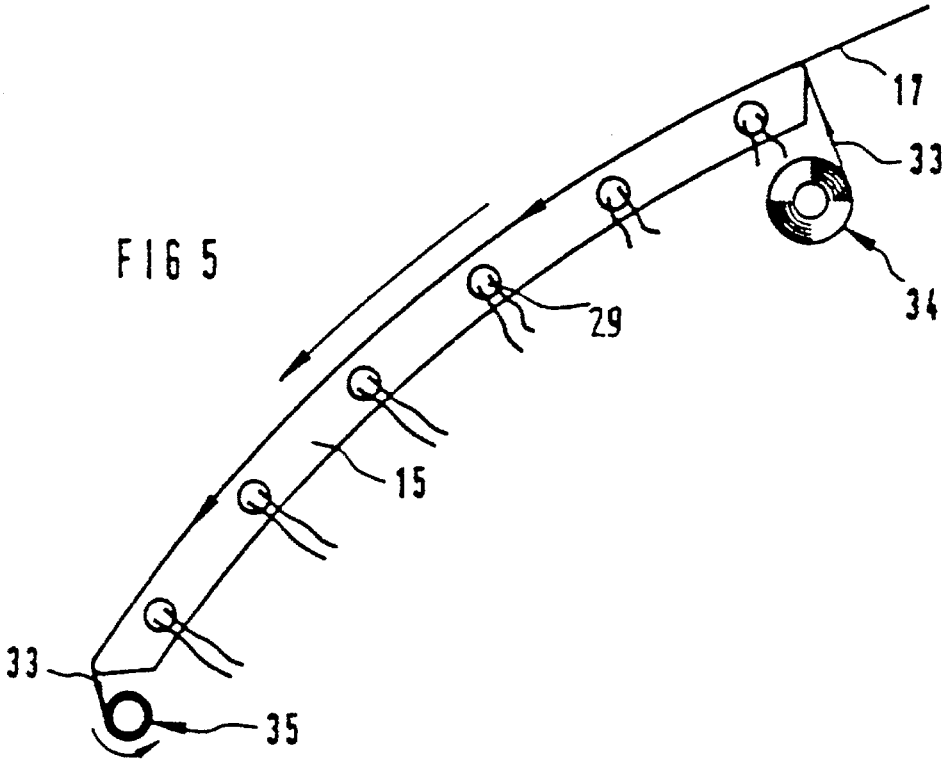
FIG. 5 is a schematic illustration of a pre-heating saddle with a corresponding film conveying means.

In an exemplary embodiment shown in FIG. 5, the toner-repellant layer 30 is designed as a thin film 33. The film 33 extends over the entire width of the pre-heating saddle. It is wound on a reel 34 as a reserve supply, this reel 34 being attached under the pre-heating saddle in the saddle entry region. This film, proceeding from this supply reel 34, is stretched over the pre-heating saddle up to the outlet of the heating saddle in the paper running direction and is in turn wound up on a take-up reel 35 under the pre-heating saddle. With the assistance of a drive means coupled to the take-up reel 35, the film is moved extremely slowly in relationship to the speed of the recording medium and is wound onto the take-up reel 35. A film supply is located on the supply reel 34 of the admission side; this can be designed for the entire service life of the printer. The pre-heating saddle is designed maintenance-free in this way.

Figure 6:
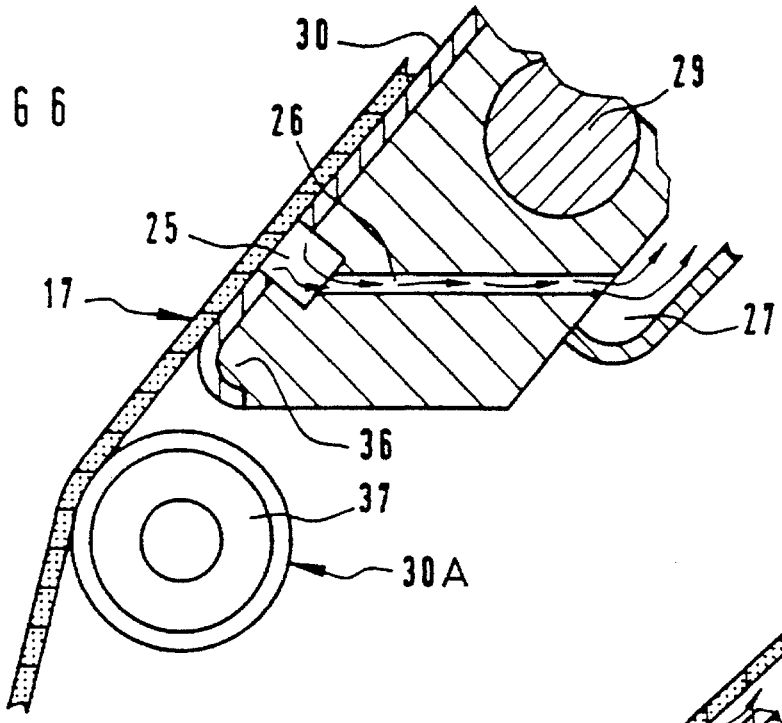
FIG. 6 is a schematic sectional view of a pre-heating saddle with an allocated smoothing roller.

In order to obtain a fold-free entry of the recording medium web 17 into the fixing gap between fixing drum 11 and pressure roller 12, it is beneficial to guide the paper web around the paper discharge saddle edge 36 of the pre-heating saddle in a wrap. However, extreme wear of the toner image already fixed on the recording medium occurs in this wrap region. According to an embodiment shown in FIG. 6, this wear can be prevented in that one or more deflection rollers 37 in the form of smoothing rollers are arranged in the wrap region, these likewise being potentially provided with a toner-repellant coating 30A. The smoothing rollers 37 steer the recording medium 17 out of a running direction defined by the sliding surface 24 into an admission direction to the heat transfer fixing station, namely with a deflection angle that is dimensioned such that a smoothing effect is exerted on the recording medium 17.

When a relatively high proportion of graphite or glass fibers is added to the toner-repellant layer 30 for achieving a high resistance to wear of the surface, then the repellency of the surface to toner can be potentially reduced. In order to prevent a transfer of the toner image onto the pre-heating saddle surface in such instances during a long waiting or standby status of the printer device, it is beneficial to lift the recording medium 17 off from the surface of the pre-heating saddle in the standby condition of the printer device.

Figure 7:
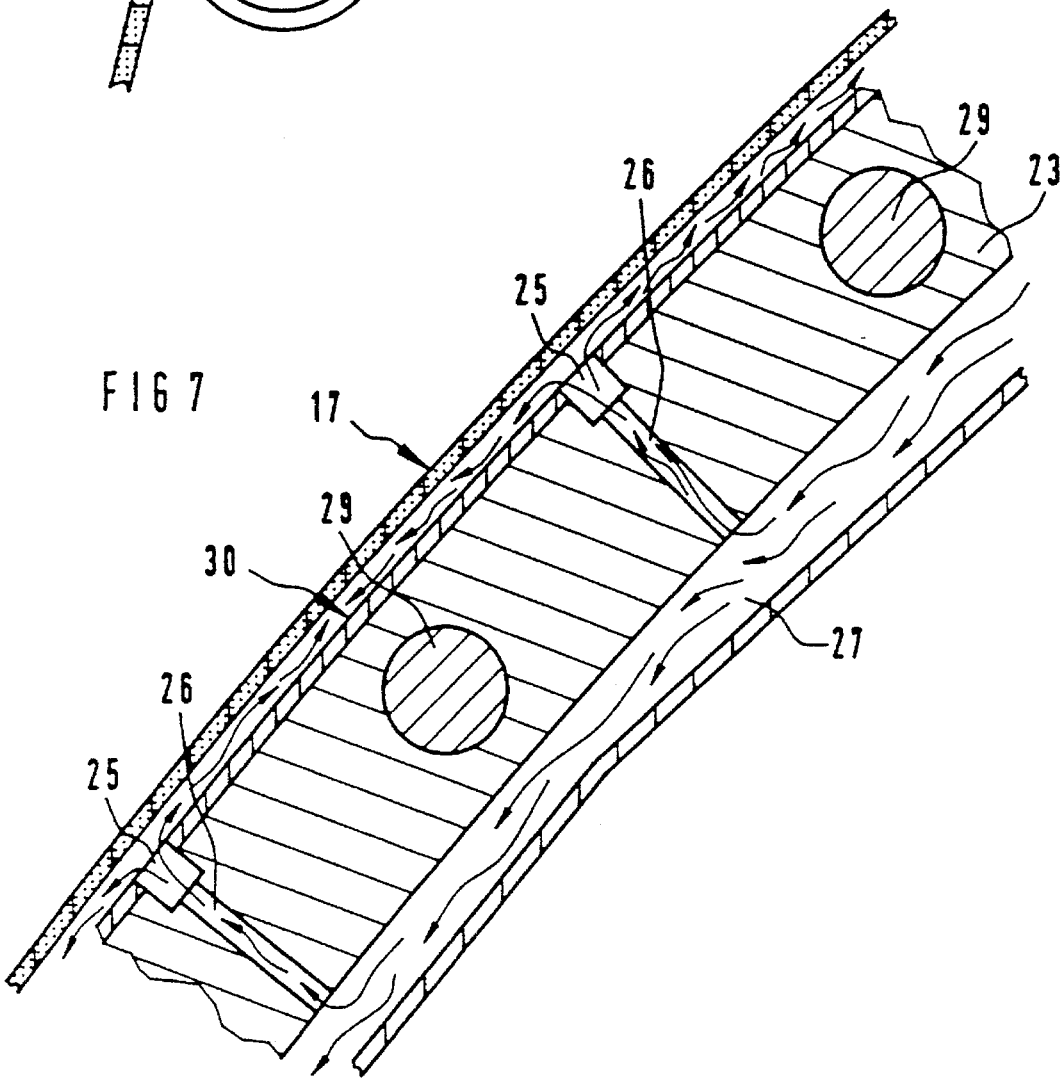
FIG. 7 is a schematic sectional view of a portion of a pre-heating saddle having a pneumatic means for producing an air pillow between the recording medium and the pre-heating saddle as needed.

In the exemplary embodiment of FIG. 7, air is supplied to the bores 26 and to the slots 25 via the pneumatic channel 27 during the standby status for this purpose, so that an air pillow that holds the recording medium 17 at a distance from the sliding surface 24 arises between sliding surface 24 and recording medium 17. Sticking of the recording medium to the surface of the pre-heating saddle is thus precluded. When a film 33 as shown in FIG. 5, is employed as a toner-repellant layer, then an air cushion can be similarly produced between film 33 and the pre-heating saddle.

Figure 8:
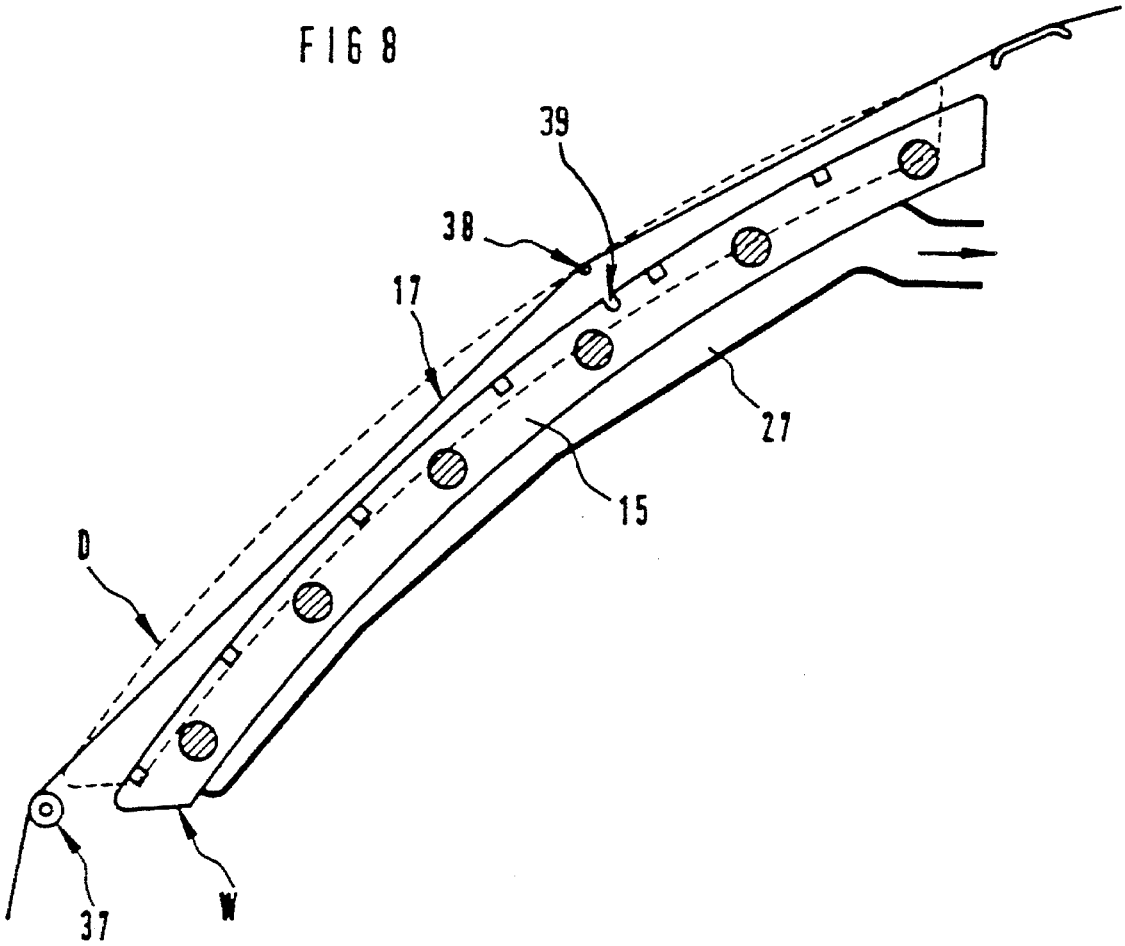
FIG. 8 is a schematic sectional view of a pre-heating saddle having a corresponding mechanical lift-off device for the recording medium.

Another possibility for lifting the recording medium off from the pre-heating saddle in the standby mode of the printer device is shown in FIG. 8. A lift-off element, for example in the form of a tension wire 38, that engages under the recording medium 17 in the region of the pre-heating saddle, is stationarily arranged in mounts of the printer device, such that the tension wire 38 comes to lie in a recess 39 of the pre-heating saddle in a position D of the pre-heating saddle allocated to the printing mode. When the pre-heating saddle or the heating saddle is pivoted out of the printing position D into a waiting position W, the tension wire 38 remains stationary and the paper web 17 is thereby lifted off from the hot surface of the pre-heating saddle.

Another possibility is a pivoting of the tension wire 38 or other paper deposit elements out of the surface of the pre-heating saddle and lowering them in turn into the surface when the printing mode is initiated.

In electrographic printer devices of the newer generation, the recording medium 17 is automatically inserted into the printer device. Among other things, the paper web must thereby be conducted over the pre-heating saddle. Coatings of fluorine compounds such as PTFE or PFA electrostatically charge to an extreme degree on their surface when paper slides thereon. It can thus occur that the electrostatic forces produced in this way impede further conveying of the paper web 17. Such electrostatic charges can be prevented by mixing electrostatically conductive substances, for example graphite or similar materials, into the toner-repellant layer 30. When the toner-repellant layer 30 is composed of a layer glued onto the pre-heating saddle, it is necessary to likewise design the adhesive to be conductive in order to thus produce a conductive connection to the pre-heating saddle, which is beneficially grounded.

Although various minor changes and modifications might be proposed by those skilled in the art, it will be understood that I wish to include within the claims of the patent warranted hereon all such changes and modifications which reasonably come within my contribution to the art.

I claim as my invention:

1. A thermal fixing system for fixing toner images on a front side of a recording medium in an electrographic printer or copier device, and wherein a back side of the recording medium already has a fixed toner image, comprising:

a heat transfer fixing station for fixing the toner images on the recording medium by direct contact between the recording medium and at least one heating roller;

a pre-heating saddle preceding the heat transfer fixing station in a running direction of the recording medium for pre-heating the recording medium and having a sliding surface allocated thereto for heating and supporting the recording medium over substantially all of its back side at a contact region, said sliding surface comprising a toner-repellant material covering all of said contact region with the recording medium;

a device for separating the recording medium from the pre-heating saddle as needed; and said device for separating comprising a lift-off element engaging behind the recording medium over a width in a region of the pre-heating saddle, the pre-heating saddle and lift-off element being designed movable relative to one another such that in a lift-off condition, the recording medium is guided over the lift-off element at a spacing from the pre-heating saddle.

2. A thermal fixing system according to claim 1 wherein said toner-repellant material is formed of a fluorine compound.

3. A thermal fixing system according to claim 2 wherein said toner repellant material comprises one of a PTFE or PFA compound.

4. A thermal fixing system according to claim 1 wherein said toner-repellant material is electrostatically conductive.

5. A thermal fixing system according to claim 1 wherein said toner-repellant material comprises a sliding surface interchangeably securable to said pre-heating saddle.

6. A thermal fixing system according to claim 1 wherein said sliding surface comprises a film with a thin, thermally conductive adhesive layer for fastening to the pre-heating saddle.

7. A thermal fixing system according to claim 1 wherein said lift-off element comprises a cable-like element.

8. A thermal fixing system according to claim 1 wherein said toner-repellant material comprises a sprayed-on layer on said pre-heating saddle.

9. A thermal fixing system according to claim 1 wherein said toner-repellant layer of material is applied onto a carrier surface of said pre-heating saddle.

10. A thermal fixing system for fixing toner images on a front side of a recording medium in an electrographic printer or copier device, and wherein a back side of the recording medium already has a fixed toner image, comprising:

a heat transfer fixing station for fixing the toner images on the recording medium;

a pre-heating saddle preceding the heat transfer fixing station in a running direction of the recording medium and having a sliding surface allocated thereto for accepting the recording medium over its back side, said sliding surface comprising a toner-repellant material at least in a contact region with the recording medium; and said sliding surface comprising a film proceeding from a supply region, guided over the pre-heating saddle, and terminating at a delivery region.

11. A thermal fixing system according to claim 10 wherein a drive unit is provided for moving the film over the pre-heating saddle.

12. A thermal fixing system for fixing toner images on a front side of a recording medium in an electrographic printer or copier device, and wherein a back side of the recording medium already has a fixed toner image, comprising;

a heat transfer fixing station for fixing the toner image on the recording medium;

a pre-heating saddle preceding the heat transfer fixing station in a running direction of the recording medium and having a sliding surface allocated thereto for accepting the recording medium over its back side, said sliding surface comprising a toner-repellant material at least in a contact region with the recording medium;

a device for separating the recording medium from the pre-heating saddle as needed; and said device for separating comprising a pneumatic device having air exit openings allocated to the pre-heating saddle for generating an air pillow for separating the recording medium from the pre-heating saddle.

13. A thermal fixing system for fixing toner images on a front side of a recording medium in an electrographic printer or copier device, and wherein a back side of the recording medium already has a fixed toner image, comprising:

a heat transfer fixing station for fixing the toner images on the recording medium;

a pre-heating saddle preceding the heat transfer fixing station in a running direction of the recording medium and having a sliding surface allocated thereto for accepting the recording medium over its back side, said sliding surface comprising a toner repellant material at least in a contact region with the recording medium; and said pre-heating saddle comprising at least one smoothing roller at an end facing toward the heat transfer fixing station, the recording medium being deflected over said at least one smoothing roller from a running direction defined by the sliding surface to an admission direction of the heat transfer fixing station, a deflection angle over said smoothing roller being dimensioned such that a smoothing effect is exerted on the recording medium.

14. A thermal fixing system for fixing toner images on a front side of a recording medium in an electrographic printer or copier device, and wherein a back side of the recording medium already has a fixed toner image, comprising:

a heat transfer fixing station for fixing the toner images on the recording medium;

a pre-heating saddle preceding the heat transfer fixing station in a running direction of the recording medium and having a sliding surface allocated thereto for accepting the recording medium over its back side, said sliding surface comprising a toner-repellant material at least on a contact region with the recording medium; and a smoothing roller having a toner-repellant layer thereon at one end of said pre-heating saddle.

15. A thermal fixing system for fixing toner images on a front side of a recording medium in an electrographic printer or copier device, and wherein a back side of the recording medium already has a fixed toner image, comprising:

a heat transfer fixing station for fixing the toner images on the recording medium;

a pre-heating saddle preceding the heat transfer fixing station in a running direction of the recording medium and having a sliding surface allocated thereto for accepting the recording medium over its back side, said sliding surface comprising a toner-repellant material at least in a contact region with the recording medium; and said pre-heating saddle having a first heating zone of lower temperature designed as a first heating zone pre-heating saddle and a second heating zone with a higher temperature designed as a high temperature heating saddle following the low temperature pre-heating saddle in said running direction of the recording medium.

16. A thermal fixing system for fixing toner images on a front side of a recording medium in an electrographic printer or copier device, and wherein a back side of the recording medium already has a fixed toner image, comprising:

a heat transfer fixing station for fixing the toner images on the recording medium;

a pre-heating saddle preceding the heat transfer fixing station in a running direction of the recording medium and having a sliding surface allocated thereto for accepting the recording medium over its back side, said sliding surface comprising a toner-repellant material at least in a contact region with the recording medium; and said pre-heating saddle comprising at least one thin metal plate having said toner-repellant layer coated thereon, and wherein said plate is interchangeably secured on a base structure of the pre-heating saddle.

* * * * *